US009935389B1

(12) United States Patent
Irish

(10) Patent No.: US 9,935,389 B1
(45) Date of Patent: Apr. 3, 2018

(54) INLINE CONNECTOR HOUSING ASSEMBLIES WITH REMOVABLE TPA

(71) Applicant: Sumitomo Wiring Systems, Ltd., Yokkaichi, Mie (JP)

(72) Inventor: Danielle Irish, Farmington Hills, MI (US)

(73) Assignee: Sumitomo Wiring Systems, Ltd., Yokkaichi-shi, Mie (JP)

( * ) Notice: Subject to any disclaimer, the term of this patent is extended or adjusted under 35 U.S.C. 154(b) by 0 days.

(21) Appl. No.: 15/440,310

(22) Filed: Feb. 23, 2017

(51) Int. Cl.
*H01R 13/627* (2006.01)
*H01R 13/422* (2006.01)

(52) U.S. Cl.
CPC ..... *H01R 13/4223* (2013.01)

(58) Field of Classification Search
CPC H01R 13/4223; H01R 13/641; H01R 13/639; H01R 13/6272
USPC ..... 439/682, 352
See application file for complete search history.

(56) References Cited

U.S. PATENT DOCUMENTS 4,370,013 A * 1/1983 Niitsu ..... H01R 13/6272 439/352
4,634,204 A * 1/1987 Detter ..... H01R 13/641 439/347
4,867,699 A * 9/1989 Oda ..... H01R 13/64 439/350
4,906,203 A * 3/1990 Margrave ..... H01R 13/7032 439/188
4,946,404 A * 8/1990 Takenouchi ..... H01R 13/641 439/352
4,984,998 A * 1/1991 Duncan ..... H01R 13/4367 439/352
5,120,255 A * 6/1992 Kouda ..... H01R 13/641 439/489
5,160,283 A * 11/1992 Fry ..... H01R 13/4362 439/752
5,181,865 A * 1/1993 Hayes, Sr. ..... H01R 13/4365 29/842
5,192,225 A * 3/1993 Suzuki ..... H01R 13/6272 439/350
5,203,718 A * 4/1993 Chishima ..... H01R 13/641 439/350
5,257,944 A * 11/1993 Kennedy ..... H01R 13/639 439/347

(Continued)

*Primary Examiner* — Abdullah Riyami
*Assistant Examiner* — Vladimir Imas
(74) *Attorney, Agent, or Firm* — Dinsmore & Shohl LLP

(57) ABSTRACT

An inline connector housing assembly having a terminal positioning assurance configured to be released from the inline connector housing assembly so as to allow for the replacement of either a male or female electric connector is provided. The inline connector housing assembly includes a male housing, a female housing and at least one terminal positioning assurance. The male housing has a first elongated body with a first through-bore. A first finger lock is disposed within the first elongated body, and a locking plate is disposed within the first elongated body opposite the first finger lock. The locking plate includes a receiving aperture defining a first lip. The female housing includes a second elongated body with a second through-bore configured to receive the male housing. The terminal positioning assurance is removably engaged within the male housing and configured to engage the first finger lock.

16 Claims, 9 Drawing Sheets

(56) References Cited

U.S. PATENT DOCUMENTS 5,292,258 A * 3/1994 Sakurai ..... H01R 13/6275 439/352
5,330,369 A * 7/1994 Nozaki ..... H01R 13/641 439/350
5,486,118 A * 1/1996 Colleran ..... H01R 13/436 439/374
5,507,666 A * 4/1996 Yamanashi ..... H01R 13/641 439/354
5,520,553 A * 5/1996 Cecil, Jr. ..... H01R 13/4365 439/595
5,591,041 A * 1/1997 Cecil, Jr. ..... H01R 13/506 439/352
5,628,649 A * 5/1997 Yagi ..... H01R 13/6272 439/354
5,672,073 A * 9/1997 Matsumura ..... H01R 13/641 439/188
5,681,178 A * 10/1997 Kunkle ..... H01R 13/641 439/352
5,685,729 A * 11/1997 Reider ..... B60R 16/0238 439/206
5,711,684 A * 1/1998 Inoue ..... H01R 13/6272 439/354
5,720,623 A * 2/1998 Polenick ..... H01R 13/641 439/352
5,879,180 A * 3/1999 Iwahori ..... H01R 13/641 439/352
5,910,027 A * 6/1999 Wayt ..... H01R 13/6272 439/352
5,921,822 A * 7/1999 Kennedy ..... H01R 13/187 439/851
6,045,404 A * 4/2000 Myer ..... H01R 13/4223 439/595
6,068,507 A * 5/2000 Popa ..... H01R 13/641 439/352
6,116,939 A * 9/2000 Fukuda ..... H01R 13/6272 439/354
6,179,643 B1 * 1/2001 Fukuda ..... H01R 13/641 439/353
6,290,539 B1 * 9/2001 Wilber ..... H01R 13/506 439/595
6,435,895 B1 * 8/2002 Fink ..... H01R 13/6272 439/352
6,439,915 B2 * 8/2002 Kurimoto ..... H01R 13/6272 439/352
6,447,170 B1 * 9/2002 Takahashi ..... H01R 13/6273 385/53
6,491,542 B1 * 12/2002 Zerebilov ..... H01R 13/4226 439/352
6,648,669 B1 * 11/2003 Kim ..... H01R 13/6272 439/357
6,755,688 B2 6/2004 Hall et al.
6,780,045 B2 * 8/2004 Shuey ..... H01R 13/641 439/352
6,827,609 B1 * 12/2004 Martin ..... H01R 13/4365 439/595
6,881,081 B2 * 4/2005 Gundermann ... H01R 13/62944 439/157
6,884,106 B2 4/2005 Shuman et al.
6,908,329 B2 * 6/2005 Kozono ..... H01R 13/641 439/352
6,935,893 B1 * 8/2005 Flowers ..... H01R 13/4365 439/595
6,979,225 B2 * 12/2005 Solano ..... H01R 13/521 439/276
7,004,790 B2 * 2/2006 Martin ..... H01R 13/4362 439/595
7,044,806 B2 * 5/2006 Sian ..... H01R 13/424 439/595
7,044,808 B1 5/2006 Foltz et al.
7,063,578 B2 * 6/2006 Goto ..... H01R 13/4361 439/595
7,255,580 B2 * 8/2007 Foltz ..... H01R 13/62955 439/157
7,351,098 B2 * 4/2008 Gladd ..... H01R 9/037 439/271
7,470,138 B1 * 12/2008 Chen ..... H01R 13/506 439/352
7,479,025 B2 * 1/2009 Lee ..... H01R 13/6277 439/349
7,544,081 B2 * 6/2009 Lim ..... H01R 13/4361 439/352
7,601,019 B2 * 10/2009 Hsieh ..... H01R 13/426 439/345
7,625,251 B2 * 12/2009 Martin ..... H01R 13/4223 439/752
7,762,854 B1 * 7/2010 Peng ..... H01R 13/508 439/578
7,867,042 B2 * 1/2011 Shuey ..... H01R 13/4365 439/595
7,914,327 B2 * 3/2011 Campbell ..... H01R 13/4365 439/595
8,241,052 B2 * 8/2012 Mulot ..... H01R 13/639 439/299
8,408,950 B2 * 4/2013 Jeon ..... H01R 13/4365 439/595
8,419,485 B2 * 4/2013 Stausser ..... H01R 13/4362 439/559
9,039,462 B2 * 5/2015 Yoon ..... H01R 13/62 439/752
9,054,454 B2 * 6/2015 Gomez ..... H01R 13/631
9,054,458 B1 * 6/2015 Ng ..... H01R 13/641
9,231,342 B2 * 1/2016 Kataoka ..... H01R 13/639
9,281,619 B2 * 3/2016 Morello ..... H01R 13/639
9,362,676 B2 * 6/2016 Puhl ..... H01R 13/6273
9,368,909 B2 * 6/2016 Yagi ..... H01R 13/631
9,425,534 B2 * 8/2016 Schmidt ..... H01R 13/6272
9,680,256 B1 * 6/2017 Lane ..... H01R 13/6273
2008/0124966 A1 * 5/2008 Lim ..... H01R 13/641 439/357

* cited by examiner

INLINE CONNECTOR HOUSING ASSEMBLIES WITH REMOVABLE TPA

TECHNICAL FIELD

The present specification generally relates to inline connector housing assemblies.

BACKGROUND

Inline connector housing assemblies include a male housing for housing male electric connectors and a female housing for housing female electric connectors. The female electric connectors are configured to receive the male connectors. The inline connector housing assembly includes Terminal Positioning Assurances (referenced herein as "TPA" or "TPAs" as the case may be. The TPAs are positively locked in place when the male and female housings are coupled together. Accordingly, replacement of a damaged or worn male or female electric connector requires the replacement of the entire connector assembly.

Accordingly, it remains desirable to have an inline connector housing assembly wherein the TPAs may be released so as to allow for the replacement of either a male or female electric connector.

SUMMARY

In one embodiment, an inline connector housing assembly includes a male housing and a female connector housing. The male connector housing is configured to house a male electric connector and the female housing is configured to house a female electric connector. The female housing is further configured to receive in a locking manner the male housing so as to connect the male electric connector with the female electric connector. The inline connector housing assembly further includes a terminal positioning assurance removably engaged within one of either the male housing or female housing so as to allow for the replacement of either the male electric connector or the female electric connector.

In one embodiment of the inline connector housing assembly, the terminal positioning assurance is a male terminal positioning assurance removable coupled within the male housing. The male housing includes a first finger lock and a receiving aperture. The male terminal positioning assurance includes a locking mechanism and a ramp shape surface configured to urge the first finger lock into an engaged position.

The locking mechanism is configured to engage the receiving aperture so as to engage the male housing in a first locking condition and a second locking condition. In the first locking condition, the locking mechanism secures the male terminal positioning assurance to the male housing in such a manner that the ramp shape surface is disengaged from the first finger lock and in the second locking condition, the ramp shape surface engages the first finger lock.

In another embodiment, the inline connector housing assembly includes a female terminal positioning assurance removable coupled within the female housing. The female terminal positioning assurance includes a body bounding a passage. The passage is configured to receive a second finger lock and a retainer. The second finger lock and the retainer being resilient members are disposed on the female housing.

In one embodiment, the retainer is an elongated member with a pair of notches, the tab configured to engage a respective one of the pair of notches so as to position the female terminal positioning assurance into a preload condition and a locked condition. In one embodiment, the female terminal positioning assurance further includes a ramp shaped surface and a tab.

Accordingly, the inline connector housing assembly is configured to couple a male and female electric connection together, but may be disengaged wherein the male and/or female terminal positioning assurance may be released from engagement with the respective male and female housing so as to allow for the replacement of a male or female electric connection, as the case may be.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Referring generally to the figures, embodiments of the present disclosure include an inline connector housing assembly having a removable terminal positioning assurance so as to allow for the replacement of a damaged or worn electric connector. The inline connector housing assembly includes a male housing for housing a male electric connector and a female housing for housing a female electric connector. The female housing is configured to receive the male housing so as to connect the male electric connector with the female electric connector. The terminal positioning assurance is removably engaged within one of either the male housing or female housing so as to allow for the replacement of either the male electric connector or the female electric connector.

As used herein the terms front and back are made in reference to the orientation of the related part when the inline connector housing assembly is assembled, wherein the front refers to the portion of the part facing the other during assembly and the back refers to the portion of the part facing away from the front. The term top and down refer to the orientation of the part as shown in the figures.

Figure 1:
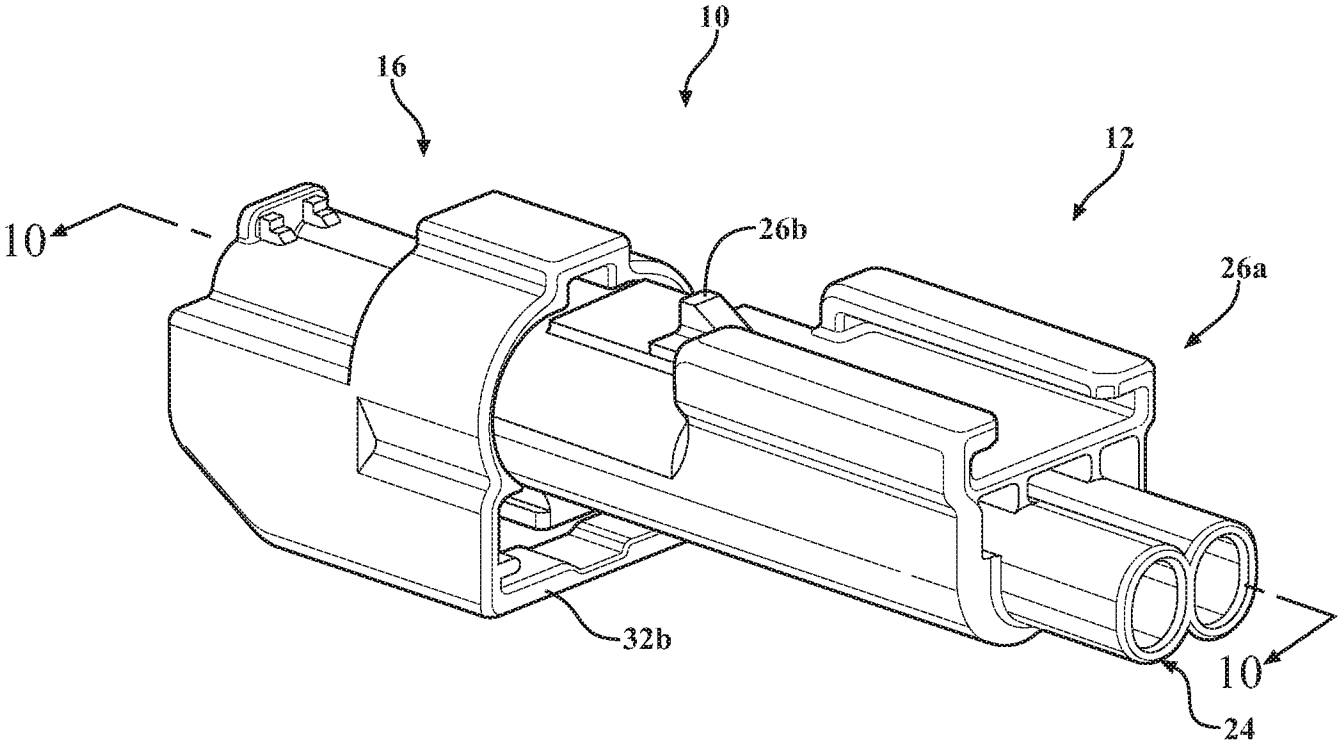
FIG. 1 schematically depicts an inline connector housing assembly according to one or more embodiments described and illustrated herein.
Figure 2:
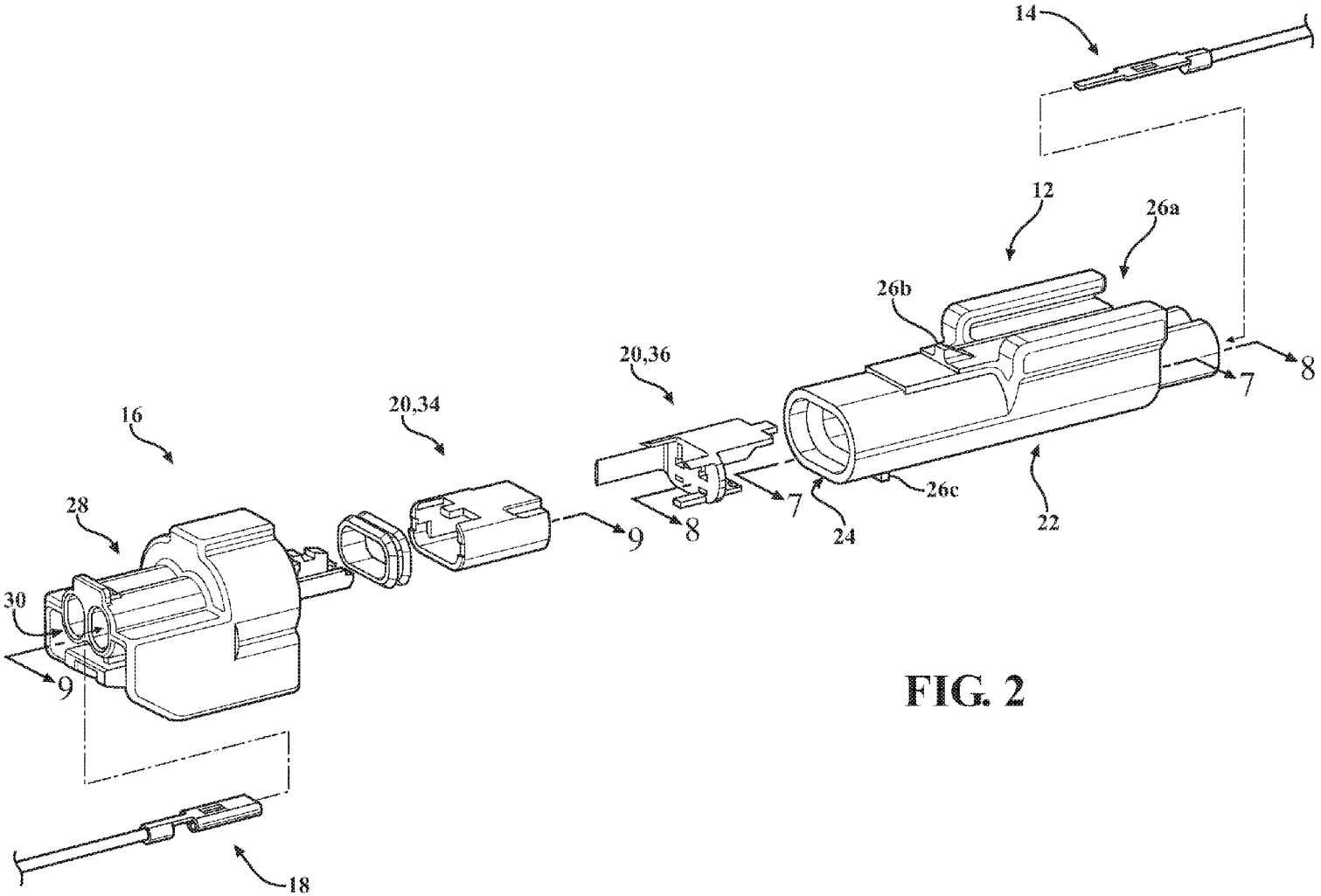
FIG. 2 is an exploded view of the inline connector housing assembly shown in FIG. 1.

With reference now to FIGS. 1 and 2 an embodiment of the inline connector housing assembly 10 is provided. The inline connector housing assembly 10 includes a male housing 12 for housing a male electric connector 14 and a female housing 16 for housing a female electric connector 18. The female housing 16 is configured to receive the male housing 12 so as to connect the male electric connector 14 with the female electric connector 18. The terminal positioning assurance 20 is removably engaged within one of either the male housing 12 or female housing 16 so as to allow for the replacement of either the male electric connector 14 or the female electric connector 18. The terminal positioning assurance 20 is also referenced herein specifically as a female terminal positioning assurance 34 and a male terminal positioning assurance 36.

The female housing 16 and the male housing 12 may be formed of a material suitable for injection molding, such as polypropylene. The male housing has a first elongated body 22 having a first through-bore 24. The first elongated body 22 has a generally oval cross-section. The outer surface of the first elongated body 22 may have a mounting structure 26*a* configured to attached to a structure. A top retention tab 26*b* is disposed on the outer surface of the first elongated body 22 and a bottom retention tab 26*c* is disposed on the outer surface of the first elongated body 22 opposite the top retention tab 26*b*.

The female housing 16 has a second elongated body 28 having a second through-bore 30 configured to receive a portion of the male housing 12. The first and second through-bores 24, 30 may have two passage-ways for receiving a pair of female and male electric connectors 18, 14. FIG. 1 shows the male housing 12 engaged with the female housing 16 in a pre-load condition. The male housing 12 may be advanced further into the female housing 16 to connect the male electric connector 14 with the female electric connector 18. In particular, the second elongated body 28 may include a hood 32*a* disposed on a top portion of the outer surface of the second elongated body 28. A catch 32*b* is disposed on the bottom portion of the outer surface of the second elongated body 28, wherein advancement of the male housing 12 into the female housing 16 until the top retention tab 26*b* and the bottom retention tab 26*c* engage the hood 32*a* and the catch 32*b* respectively.

Figure 3:
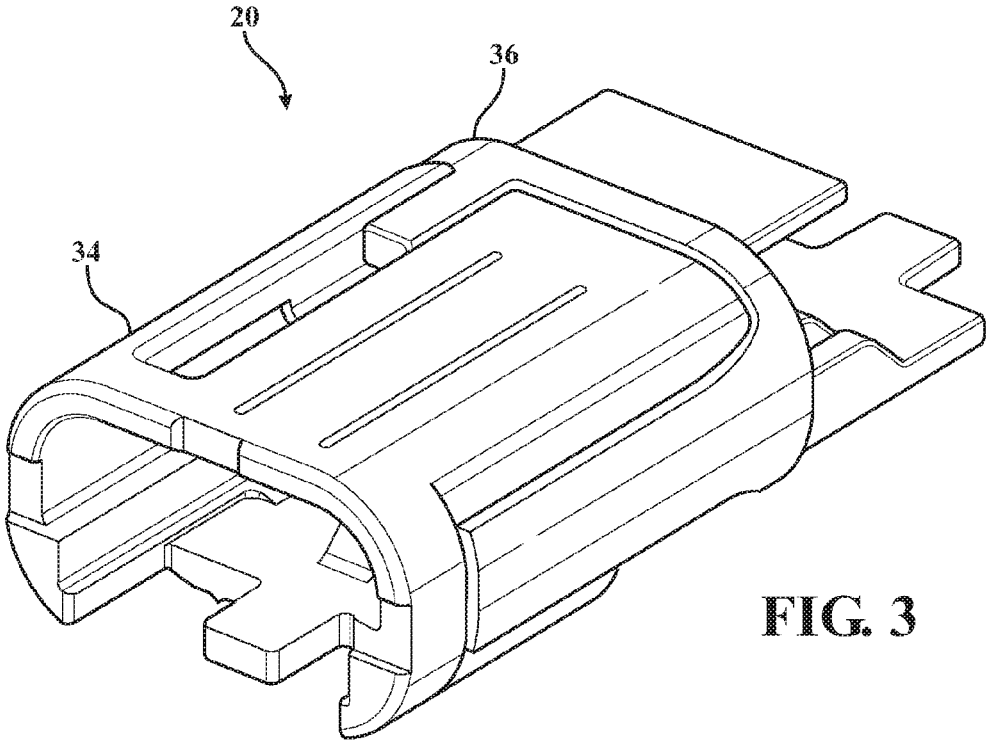
FIG. 3 schematically depicts the male terminal positioning assurance engaged with the female terminal positioning assurance.
Figure 4:
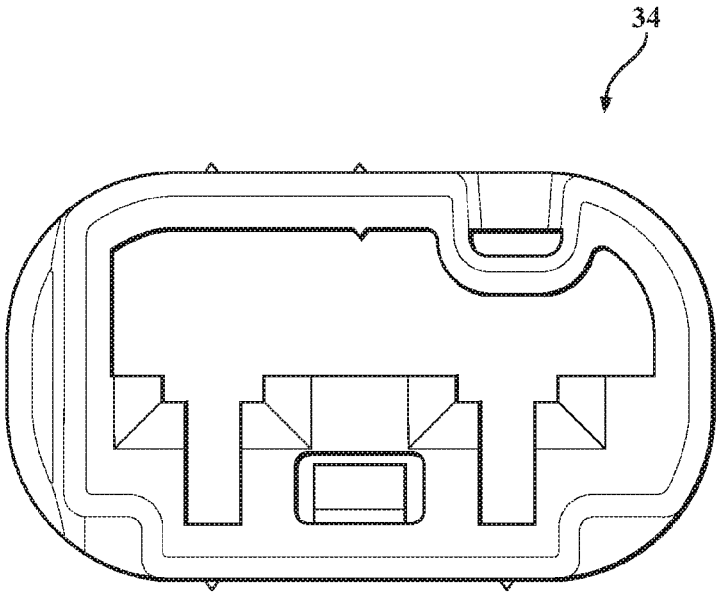
FIG. 4 is an isolated view of the female terminal positioning assurance taken from the front.
Figure 5:
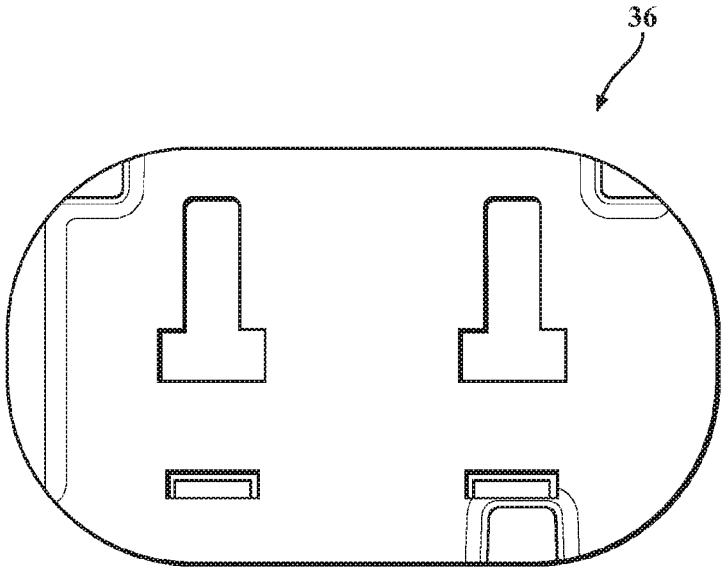
FIG. 5 is an isolated view of the male terminal positioning assurance taken from the back.
Figure 6:
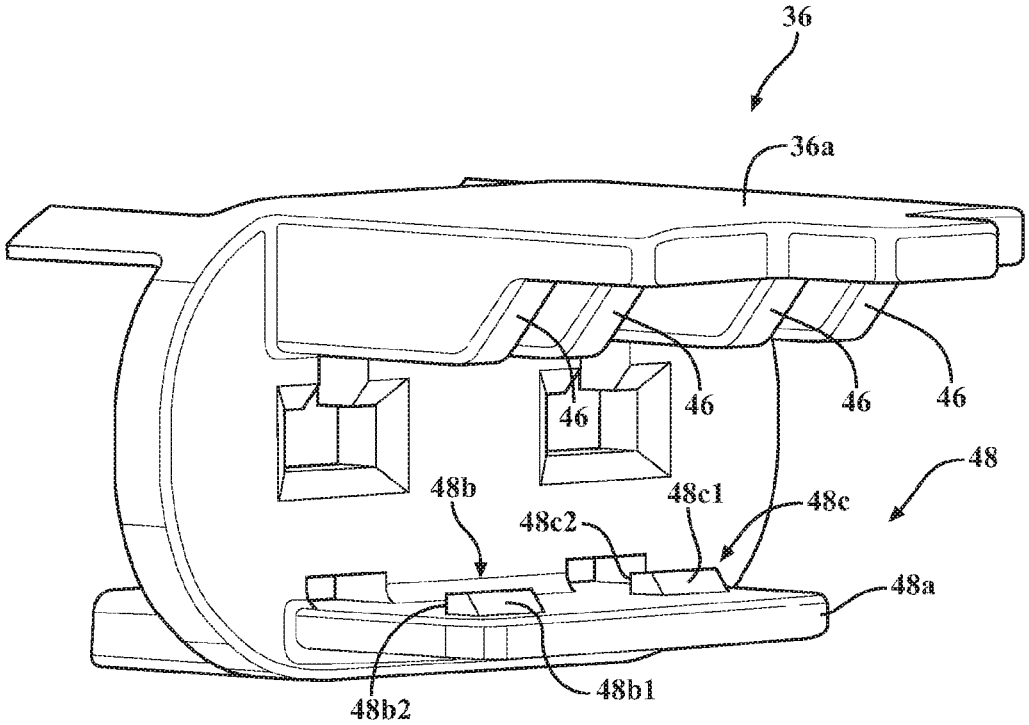
FIG. 6 is a perspective view of the male terminal positioning assurance shown in FIG. 5 taken from the front.

With reference now to FIGS. 3-6, an embodiment of a terminal positioning assurance 20 is provided. FIG. 3 shows a female terminal positioning assurance 34 coupled with a male terminal positioning assurance 36. FIGS. 4 and 5 show that the female terminal positioning assurance 34 and the male terminal positioning assurance 36 include keyed slots for receiving a terminal connection of the male electric connector 14. The ends of the female terminal positioning assurance 34 and the male terminal positioning assurance 36 are configured to mate with the ends of respective female and male housings 16, 12. The male and female terminal positioning assurance 34, 36 include features for engaging finger locks so as to create a positive lock with respective male and female electric connectors 14, 18 as discussed in detail below. FIG. 6 shows the front end of the male terminal positioning assurance 36 showing an example of a feature for engaging a finger lock.

Figure 7:
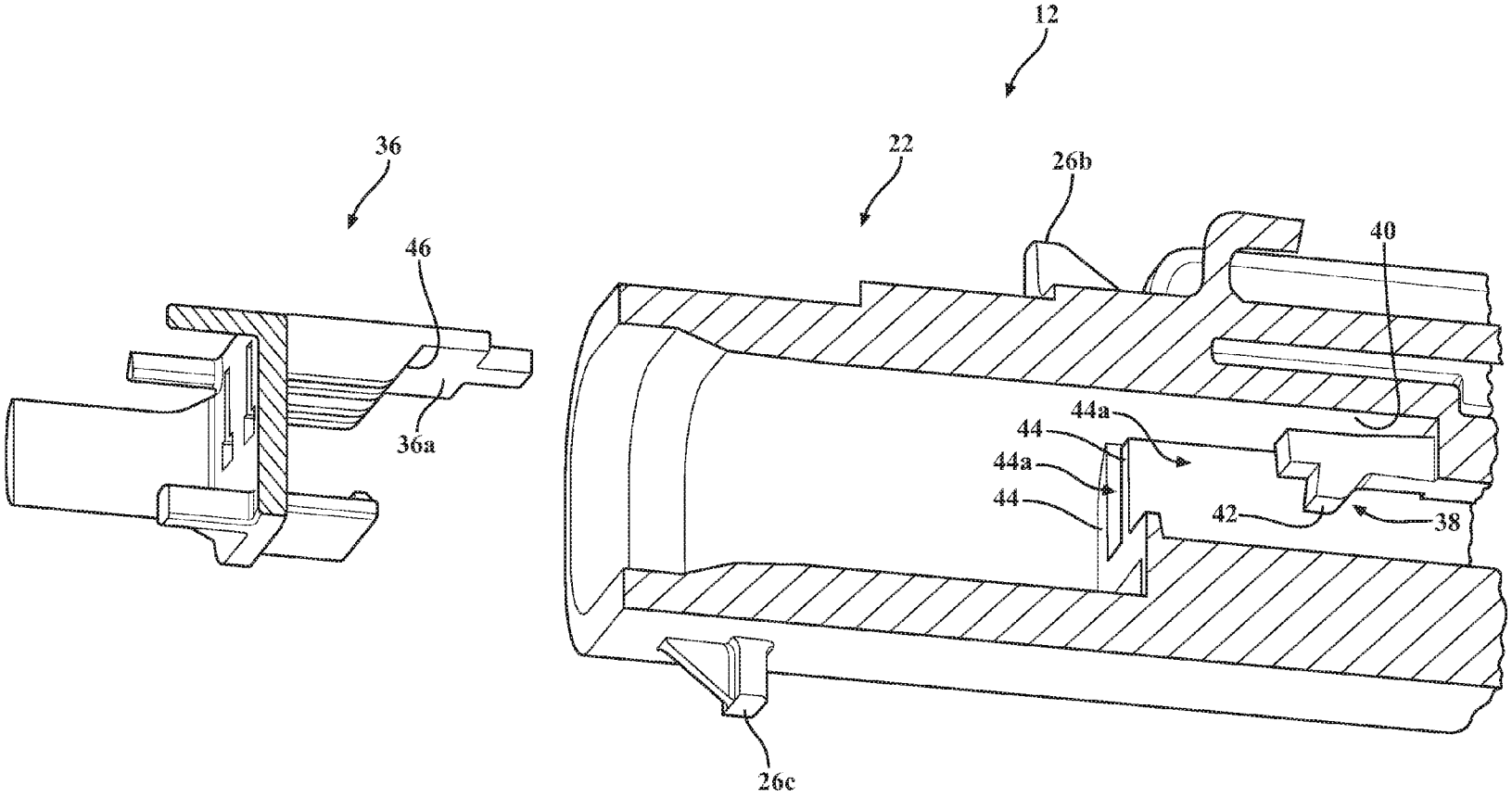
FIG. 7 is a cross sectional view of FIG. 2 taken along line 7-7.

FIG. 7 is a cross sectional view of FIG. 2 taken along line 7-7 showing an embodiment of a male terminal positioning assurance 36 and a male housing 12. The male housing 12 includes a first finger lock 38 disposed within the first elongated body 22. The first finger lock 38 is a resilient member which can flex so as to engage and disengage a male electric connector. The first finger lock 38 may be an elongated member having a top surface spaced apart from the inner wall of the first elongated body 22 so as to define a first receiving slot 40. A bottom surface of the finger lock 38 may include a male locking tab 42. Partition walls 44 divide the inner space of the first elongated body 22 into discrete slots 44*a*.

The male terminal positioning assurance 36 includes a first ramp shape surface 46 configured to urge the first finger lock 38 into an engaged position. In one embodiment, the male terminal positioning assurance 36 includes four first ramp shape surfaces 46. Each first ramp shape surfaces 46 is formed underneath a top wall 36*a* of the male terminal positioning assurance 36 and are generally planar members having an angled back surface. The top wall 36*a* is configured to fit within the first receiving slot 40 of the male housing 12, and each of the first ramp shape surfaces 46 are configured to engage with respective partition walls 44 and slots 44*a* of the male housing 12 so as to engage the first finger lock 38 with the male electric connector 14.

Figure 8:
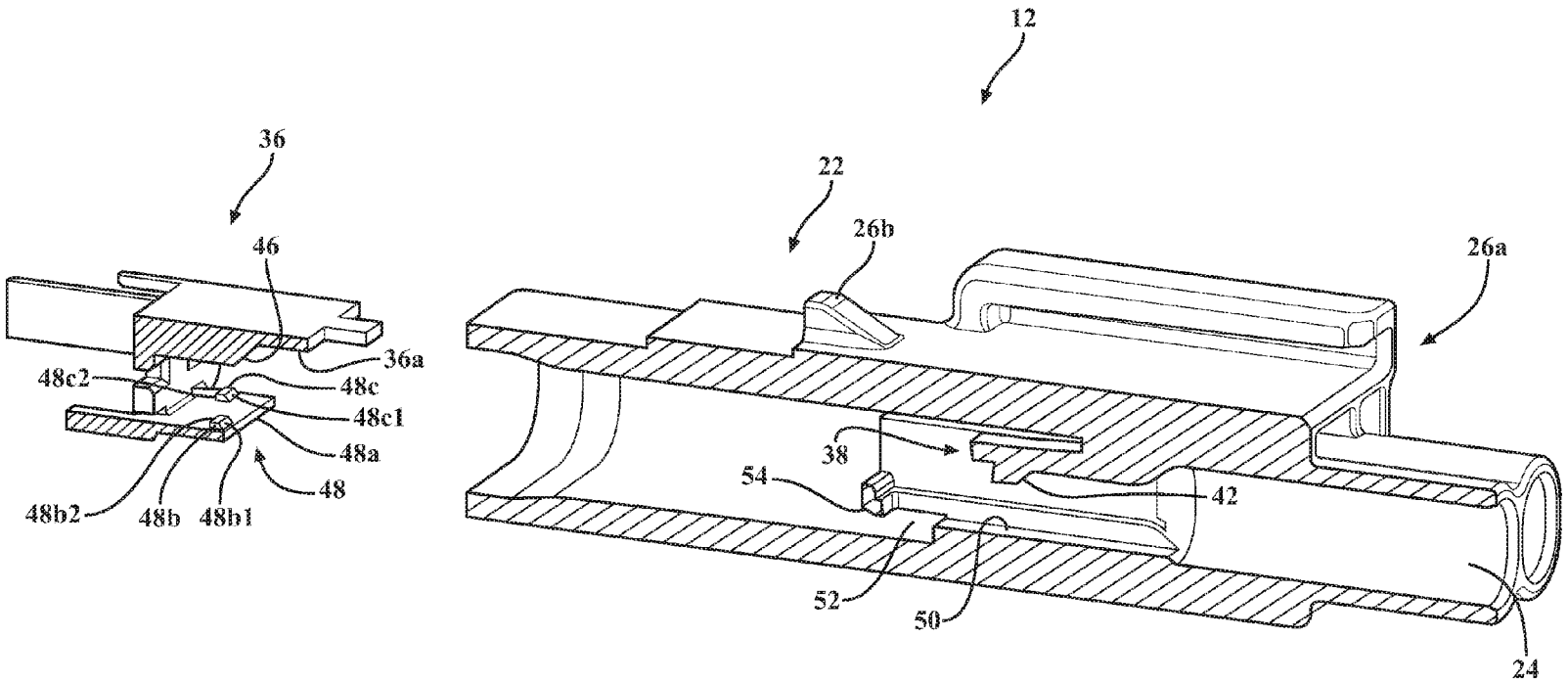
FIG. 8 is a cross sectional view of FIG. 2 taken along line 8-8.

FIG. 8 is a cross sectional view of FIG. 2 taken along line 8-8 showing an embodiment of a locking mechanism 48 disposed on the male terminal positioning assurance 36. The locking mechanism 48 configured to engage the male housing 12 in a first locking condition and a second locking condition. In the first locking condition the locking mechanism 48 secures the male terminal positioning assurance 36 to the male housing 12; however, the male terminal positioning assurance 36 is disengaged from the first finger lock 38. In the second locking condition, the first ramp shape surface 46 engages the first finger lock 38.

In one embodiment, the locking mechanism 48 includes a support plate 48*a*. The support plate 48*a* may be integrally formed to the male terminal positioning assurance 36. In one embodiment, the support plate 48*a* is a planar and resilient member disposed beneath the top wall 36*a* of the male terminal positioning assurance 36. The support plate 48*a* may include a first engagement feature 48*b* and a second engagement feature 48*c* formed on a top surface of the support plate 48*a*. The first engagement feature 48*b* is offset from the second engagement feature 48*c*. The first engagement feature 48*b* is forward of the second engagement feature 48*c* and disposed on opposite sides of the support plate 48*a*. The first engagement feature 48*b* and the second engagement feature 48*c* are generally block members each having an angled wall 48*b*1, 48*c*1 opposite a planar back wall 48*b*2, 48*c*2.

The male housing 12 further includes a locking plate 50 having a receiving aperture 52 defining a first lip 54. The first lip 54 is formed forward of the first finger lock 38 and the locking plate is disposed beneath the first finger lock so as to provide space to accommodate a male electric connector 14. The locking plate 50 is spaced apart from and above a bottom wall of the first elongated body 22 so as to define a slot for accommodating the locking plate 50. The receiving aperture 52 is dimensioned so as to accommodate both the first engagement feature 48*b* and the second engagement feature 48*c*. As shown, the angled walls 48*b*1, 48*c*1 of respective first and second engagement features 48*b*, 48*c* face the first lip 54 so as to facilitate the flex of the support plate 48*a* as the first engagement feature 48*b* or the second engagement feature 48*c* are pushed towards the receiving aperture 52, as the case may be. The planar back walls 48*b*2, 48*c*2 prevent the support plate 48*a* from disengaging the locking plate 50, thus preventing the male terminal positioning assurance 36 from backing out of the male housing 12.

Figure 9:
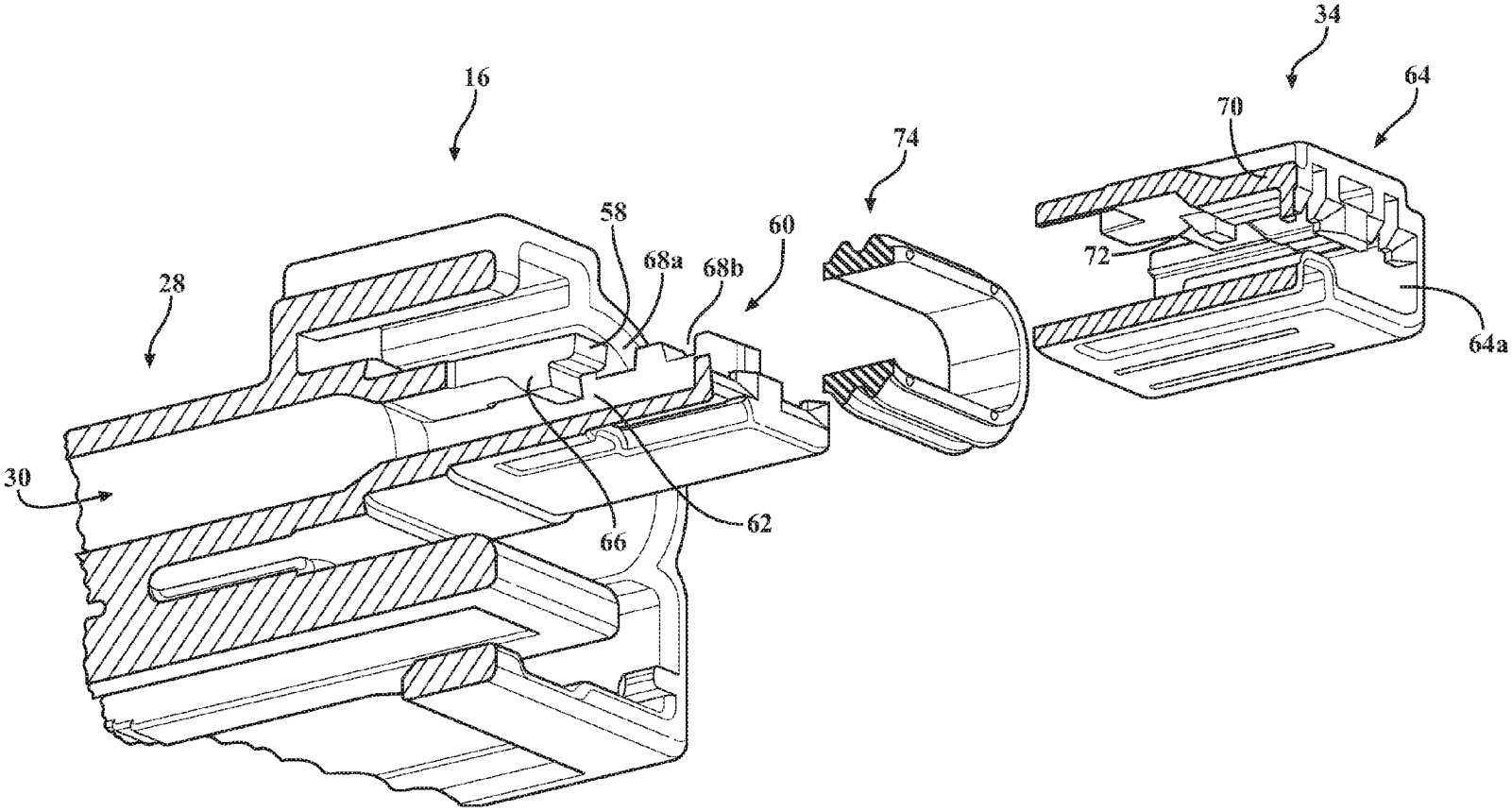
FIG. 9 is a cross sectional view of FIG. 2 taken along line 9-9.

FIG. 9 is a cross sectional view of FIG. 2 taken along line 9-9 showing an embodiment of the female terminal positioning assurance 34 and the female housing 16. The female housing 16 is configured to slidingly receive the male housing 12. The female housing 16 includes a second elongated body 28 with a second through-bore 30 dimensioned to bound the outer surface of the male housing 12*a*.

The female housing 16 includes a second finger lock 58 and a retainer 60. The second finger lock 58 and the retainer 60 are resilient members disposed within the second through-bore 30 of the female housing 16. The second finger lock 58 is configured to engage the female electric connector 18. The retainer 60 is configured to releasably engage the female terminal positioning assurance 34.

The second finger lock 58 is a resilient member which can flex so as to engage and disengage a female electric connector 18. The second finger lock 58 may be an elongated member having a top surface spaced apart from a bottom portion of the inner wall of the second elongated body 28 so as to define a second receiving slot 62. The second receiving slot 62 is configured to receive a bottom portion of the female terminal positioning assurance 34. A bottom surface of the second finger lock 58 may include a female locking tab 66 configured to engage and disengage the female electric connector 18.

The retainer 60 is a generally elongated member with a generally planar top surface. The top surface of the retainer 60 is spaced apart from a top wall of the second elongated body 28 so as to a space for accommodating a top portion of the female terminal positioning assurance 34. The top surface of the retainer 60 is spaced apart from the second finger lock 58 and includes a pair of notches 68*a*, 68*b*.

The female terminal positioning assurance 34 is removable coupled within the female housing 16. The female terminal positioning assurance 34 includes a second body 64 bounding a passage 64*a*. The passage 64*a* extends through the second body 64 so as to define open ends of the second body 64. The passage 64*a* is configured to receive the female electric connector 18 and the retainer 60 and the second finger lock 58. The top portion of the second body 64 is configured to fit between the top wall of the female housing 16 and the top surface of the retainer 60, and the bottom portion of the second body 64 is configured to within the second receiving slot 62.

The female terminal positioning assurance 34 further includes a second ramp shape surface 70 extending downwardly from the top wall of the second body 64. A second tab 72 is also disposed on the top wall of the second body 64 and extends downwardly from the top wall. The second tab 72 is configured to engage each of the notches 68 of the retainer 60 so as to position the female terminal positioning assurance 34 into a preload condition and a locked condition.

The inline connector assembly 10 may further include a gasket 74. An embodiment of a gasket 74 for use herein is illustratively shown; however any gasket 74 currently known or used in the art may be modified and adapted for use herein. The gasket is sandwiched between a leading edge of the female housing 16 and a back edge of the female terminal positioning assurance 34. The gasket 74 helps create a seal to keep out debris and moisture.

Figure 10:
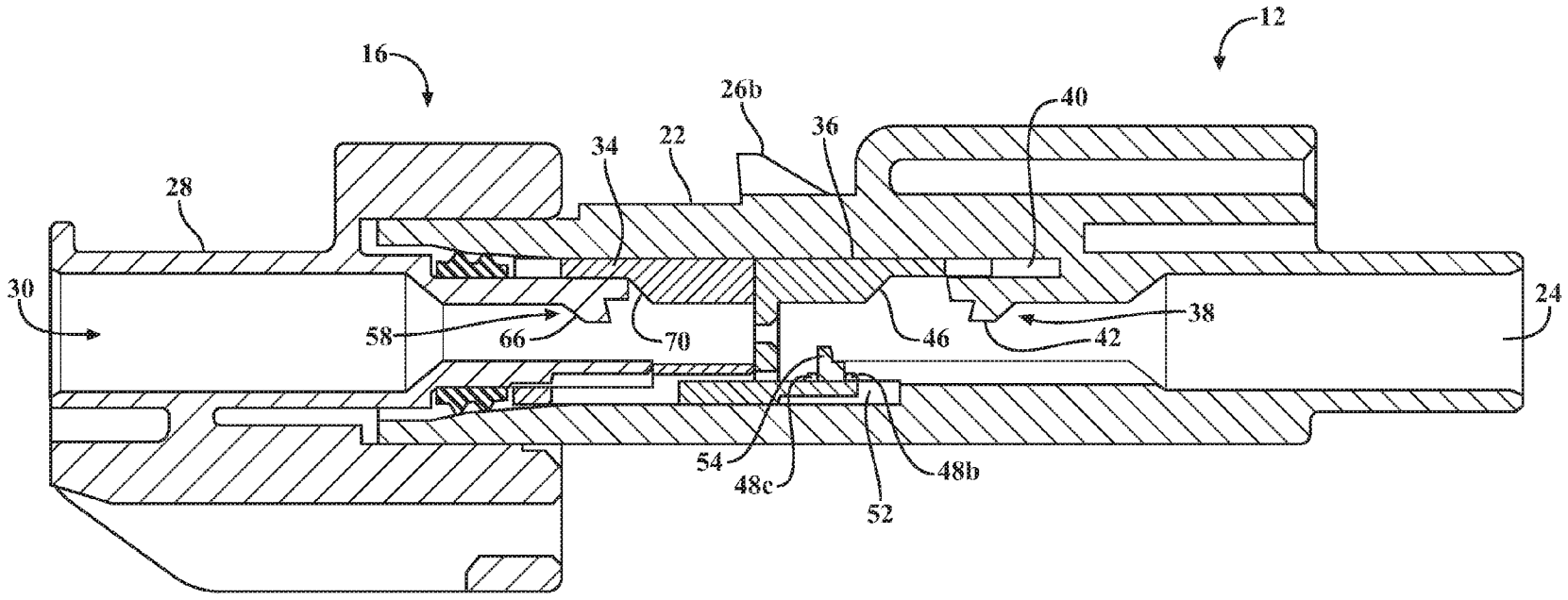
FIG. 10 is a cross sectional view of FIG. 1 taken along line 10-10 showing the connector housing assembly in a pre-load condition.

FIG. 10 is a cross sectional view of FIG. 1 taken along line 10-10 showing the inline connector assembly 10 in a preload condition. The male housing 12 is slid into the opening of the female housing 16. The male terminal positioning assurance 36 is shown in the first condition wherein the male locking tab 42 is disengaged from a locking position with the first ramp shape surfaces 46 of the male terminal positioning assurance 36. The first engagement feature 48*b* is disposed forward of the first lip 54 and within the receiving aperture 52 wherein the first lip 54 is disposed between the first and second engagement features 48*b*, 48*c*. In such a configuration, the male electric connector 14 may be inserted.

The female terminal positioning assurance 34 pressed against the gasket 74, and in the preload condition wherein the second ramp shape surface 70 is disengaged with the second finger lock 58. The second tab 72 is disposed in the first notch 68*a* so as to place the female terminal positioning assurance 34 in the preload condition wherein the female electric connector 18 may be inserted.

In operation, the male terminal positioning assurance 36 may be inserted into the male housing 12, wherein the first engagement feature 48*b* is pressed into the receiving aperture 52 of the locking plate 50 so as to engage the first lip 54 between the first engagement feature 48*b* and the second engagement feature 48*c*. The first ramp shape surfaces 46 are slid into respective slots 44*a* and the ramp shape surfaces 46 are disengaged from the first finger locks 38 by the engagement of the first engagement feature 48*b* with the first lip 54. The male electric connector 14 may then be inserted in the opening on the back end of the male housing 12 and pushed into engagement with the male locking tab 42.

The gasket 74 is mounted over the second finger lock 58 and the retainer 60. The female terminal positioning assurance 34 is also mounted over the second finger lock 58 and the retainer 60 so as to place the gasket 74 between the female terminal positioning assurance 34 and a leading edge of the female housing 16 and within the second elongated body 28 of the female housing 16. The second tab 72 is disposed within notch 68*a* so as to place the female terminal positioning assurance 34 in a preload condition wherein the second ramp shape surfaces 70 of the female terminal positioning assurance 34 is disengaged from the second finger lock 58. The female electric connector 18 may be inserted into the open back end of the female housing 16 and inserted into the female housing 16 until the second finger lock 58 engages the female electric connector 18.

Figure 11:
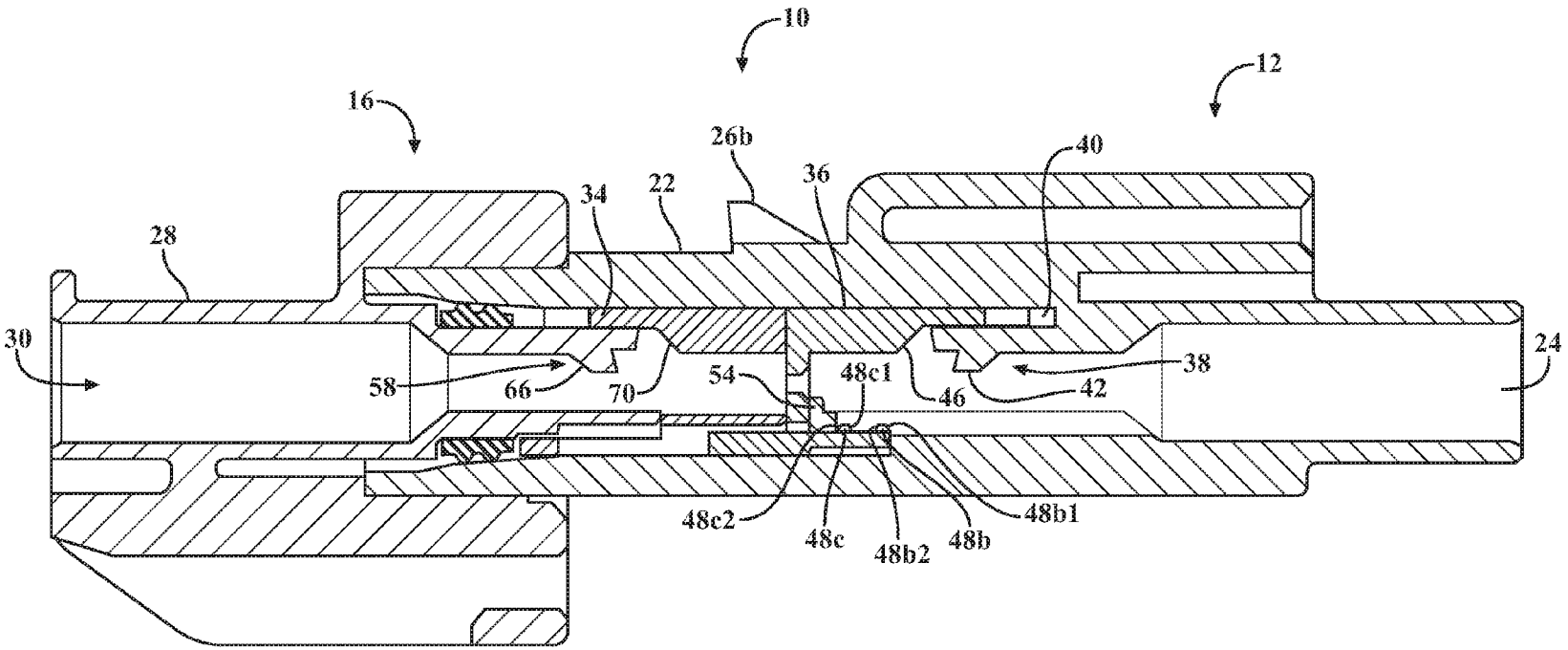
FIG. 11 is a view of FIG. 10 showing the connector housing assembly in a locked condition.

The male and female housings 12, 16 are then pressed together wherein the female terminal positioning assurance 34 and the male terminal positioning assurance 36 are pushed into the locked condition and second locking condition respectively. In the case of the female terminal positioning assurance 34, the second tab 72 is advanced forward into engagement with notch 68*b* and the second ramp shape surface 70 engages the second finger lock 58 causing the second finger lock 58 to ride up the second ramp shape surface 70 and press further down upon the female electric connector 18 so as to place the female terminal positioning assurance 34 in a locked condition, as shown in FIG. 11.

With respect to the male terminal positioning the second engagement feature 48*c* is advanced forward of the first lip 54 so as to place both the first and second engagement features 48*b*, 48*c* in the receiving aperture 52 of the locking plate 50. Simultaneously, the first ramp shape surfaces 46 are brought into engagement with the first finger lock 38 causing the first finger lock 38 to ride up the first ramp shape surfaces 46 and press further down upon the male electric connector 14 so as to place the male terminal positioning assurance 36 in the second locking condition.

In the event that the male or female electric connector 14, 18 needs to be replaced, the male and female housing 12, 16 may be disengaged from each other by releasing the bottom retention tab 26*c* of the male housing 12 from engagement of the catch 32*b* of the female housing 16. With respect to the male electric connector 14, a tool (such as a screw driver) may be inserted to the back end of the male housing 12 to push down on the support plate 48*a*, or the first or second engagement features 48*b*. 48*c* and the male terminal positioning assurance 36 may be pulled out the other end of the male housing 12. The tool may then be used to press the first finger lock upwardly so as to release the male locking tab 42 from engagement with the male electric connector 14, wherein the male electric connector 14 may be pulled out through the back end of the male housing 12 and replaced.

With respect to the female electric connector 18, the tool may be used to press the retainer 60 upwardly so as to disengage the second tab from the notch 68*b*, wherein the female terminal positioning assurance 34 may be removed. The tool may then be used to push the second finger lock 58 down so as to release the female locking tab 66 from engagement with the female electric connector 18, wherein the female electric connector 18 may be removed and replaced.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An inline connector housing assembly comprising:

a male housing for housing a male electric connector;

a female housing for housing a female electric connector, the female housing configured to receive the male housing so as to connect the male electric connector with the female electric connector, wherein the male housing includes a first through-bore extending along an axis of the male housing and a first a first finger lock disposed within the first through-bore, the first finger lock being a resilient member; and a male terminal positioning assurance removably engaged within the first through-bore of the male housing so as to allow for the replacement of the male electric connector, the male terminal positioning assurance having a first ramp shape surface configured to urge the first finger lock into an engaged position.

2. The inline connector housing assembly of claim 1, wherein the male terminal positioning assurance includes a locking mechanism configured to engage the male housing in a first locking condition and a second locking condition, wherein the first locking condition secures the male terminal positioning assurance to the male housing and wherein the male terminal positioning assurance is disengaged from the first finger lock and wherein the second locking condition the first ramp shape surface engages the first finger lock.

3. The inline connector housing assembly of claim 2, wherein the locking mechanism is a locking plate having a first engagement feature offset from a second engagement feature, the male housing includes a receiving aperture and a first lip, the first lip engaged by the first engagement feature and the second engagement feature so as to place the male terminal positioning assurance in the first locking condition and the first engagement feature and the second engagement feature are both disposed in the receiving aperture so as to place the male terminal positioning assurance in the second locking condition.

4. The inline connector housing assembly of claim 1, further including a female terminal positioning assurance removably coupled to the female housing, the female terminal positioning assurance having a second body bounding a passage, the passage configured to receive a second finger lock and a retainer, the second finger lock and the retainer being resilient members disposed on the female housing.

5. The inline connector housing assembly of claim 4, wherein the female terminal positioning assurance further includes a ramp shape surface and a second tab.

6. The inline connector housing assembly of claim 5, wherein the retainer is an elongated member with a pair of notches, the second tab configured to engage a respective one of the pair of notches so as to position the female terminal positioning assurance into a preload condition and a locked condition.

7. An inline connector housing assembly comprising:

a male housing, the male housing having a first elongated body with a first through-bore extending through the first elongated body, a first finger lock is disposed within the first elongated body, a locking plate is disposed within the first elongated body opposite the first finger lock, the locking plate having a receiving aperture defining a first lip;

a female housing for housing the male housing, the female housing having a second elongated body with a second through-bore configured to receive the male housing;

a male terminal positioning assurance removably engaged within the first through-bore of the male housing and configured to engage the first finger lock.

8. The inline connector housing assembly as set form in claim 7, wherein the first finger lock is a resilient member, the male terminal positioning assurance having a ramp shape surface configured to urge the first finger lock into an engaged position.

9. The inline connector housing assembly of claim 8, wherein the male terminal positioning assurance includes a locking mechanism configured to engage the male housing in a first locking condition and a second locking condition, wherein the first locking condition secures the male terminal positioning assurance to the male housing and wherein the male terminal positioning assurance is disengaged from the first finger lock and wherein in the second locking condition, the ramp shape surface engages the first finger lock.

10. The inline connector housing assembly of claim 9, wherein the locking mechanism is a support plate having a first engagement feature offset from a second engagement feature, the first lip engaged by the first engagement feature and the second engagement feature so as to place the male terminal positioning assurance in the first locking condition and the first engagement feature and the second engagement feature are disposed in the receiving aperture of the locking plate so as to place the male terminal positioning assurance in the second locking condition.

11. The inline connector housing assembly of claim 10, wherein the first engagement feature and the second engagement feature are generally block members having an angled wall opposite a planar back wall, the planar back walls configured to engage the first lip so as to prevent the male terminal positioning assurance from backing out of the male housing.

12. The inline connector housing assembly of claim 7, further including a female terminal assurance, the female terminal positioning assurance removably coupled within the female housing.

13. The inline connector housing assembly of claim 12, wherein the female terminal positioning assurance includes a second body bounding a passage, the passage configured to receive a second finger lock and a retainer, the second finger lock and the retainer being resilient members disposed on the female housing.

14. The inline connector housing assembly of claim 13, wherein the female terminal positioning assurance further includes a ramp shaped surface and a tab.

15. The inline connector housing assembly of claim 14, wherein the retainer is an elongated member with a pair of notches, the tab configured to engage a respective one of the pair of notches so as to position the female terminal positioning assurance into a preload condition and a locked condition.

16. The inline connector housing assembly of claim 7, wherein the male terminal positioning assurance includes a plurality of walls spaced apart from each other, the ramp shape surface disposed on each of the plurality of walls.

* * * * *